US006896568B2

(12) United States Patent
Matsuda

(10) Patent No.: US 6,896,568 B2
(45) Date of Patent: May 24, 2005

(54) EXHAUST OUTLET EQUIPMENT OF SMALL WATERCRAFT AND PIPE MOUNTING STRUCTURE

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/633,146

(22) Filed: Jul. 31, 2003

(65) Prior Publication Data

US 2004/0058597 A1 Mar. 25, 2004

(30) Foreign Application Priority Data

Aug. 7, 2002 (JP) ..... 2002-229570

(51) Int. Cl.[7] ..... B63H 21/32
(52) U.S. Cl. ..... 440/89 J
(58) Field of Search ..... 440/89 R, 89 J

(56) References Cited

U.S. PATENT DOCUMENTS 5,676,575 A * 10/1997 Fukuda et al. ..... 440/89 R
5,931,712 A * 8/1999 Hattori et al. ..... 440/89 R
6,213,828 B1 * 4/2001 Tsumiyama et al. ..... 440/89 R
6,261,140 B1 * 7/2001 Yoshida et al. ..... 440/88 R

* cited by examiner

*Primary Examiner*—Jesus D. Sotelo
(74) *Attorney, Agent, or Firm*—Alleman Hall McCoy Russell & Tuttle LLP

(57) ABSTRACT

Exhaust outlet equipment provided at a downstream end portion of an exhaust passage of a propulsion engine in a flow of an exhaust gas, wherein the engine is mounted in a small watercraft propelled by a water jet pump. The exhaust outlet equipment typically includes an exhaust pressure reducing chamber provided laterally of a pump room that contains the water jet pump, the chamber having a volume for reducing a pressure of the exhaust gas to a predetermined pressure. The exhaust pressure reducing chamber typically has an introduction port through which the exhaust gas from an exhaust pipe located on an upstream side in the flow of the exhaust gas flows into the exhaust pressure reducing chamber, and a discharge port through which the exhaust gas inside the exhaust pressure reducing chamber is discharged to an ambient side.

17 Claims, 14 Drawing Sheets

EXHAUST OUTLET EQUIPMENT OF SMALL WATERCRAFT AND PIPE MOUNTING STRUCTURE

BACKGROUND OF THE INVENTION

1. Field of the Invention

The present invention relates to an exhaust outlet equipment mounted in a small watercraft such as a personal watercraft (PWC) propelled by a water jet pump, and a pipe mounting structure forming part of the exhaust outlet equipment to mount a pipe such as an exhaust pipe or the like to a body of the watercraft.

2. Description of the Related Art

In recent years, small watercraft, for example, so-called jet-propulsion personal watercraft, have been widely used in leisure, sport, rescue activities, and the like. The jet-propulsion personal watercraft is configured to have a water jet pump that pressurizes and accelerates water sucked from a water intake generally provided on a bottom of a hull and ejects it rearward from an outlet port. Thereby, the personal watercraft is propelled.

In the jet-propulsion personal watercraft, a steering nozzle provided behind the outlet port of the water jet pump is swung either to the right or to the left by operating a bar-type steering handle to the right or to the left, to change the ejection direction of the water to the right or to the left, thereby turning the watercraft to the right or to the left.

Furthermore, since the watercraft is small, it is difficult to effectively muffle an exhaust noise of an exhaust gas from an engine for propulsion. When the engine is required to generate a relatively high power, like the engine of the personal watercraft, it is necessary to muffle the exhaust noise effectively without increasing a back pressure of an exhaust system (exhaust line).

Meanwhile, in order to allow the exhaust gas from the engine to be discharged outside the watercraft, a downstream end portion of a pipe, such as an exhaust pipe included in the exhaust system, is inserted through an opening formed through a body of the watercraft. When such a structure is formed in the body molded from FRP (fiber reinforced plastic) by a hand lay-up or spray-up method using a "concave mold (female mold)," a complex structure is required to seal a contact portion between the pipe and the body at a location where the pipe penetrates through the body, because an inner surface of the body is a rough surface.

SUMMARY OF THE INVENTION

The present invention addresses the above described condition, and an object of the present invention is to provide an exhaust outlet equipment of a small watercraft, which is capable of effectively muffling an exhaust noise of an exhaust gas from an engine without increasing a back pressure of an exhaust system (exhaust line) of the engine. Another object of the present invention is to provide a pipe mounting structure being suitable for mounting a pipe such as an exhaust pipe of the exhaust outlet equipment to a body of the watercraft.

According to the present invention, there is provided an exhaust outlet equipment provided at a downstream end portion of an exhaust passage of a propulsion engine in a flow of an exhaust gas, the engine being mounted in a small watercraft propelled by a water jet pump, the equipment comprising an exhaust pressure reducing chamber provided laterally of a pump room that contains the water jet pump, the chamber having a volume for reducing a pressure of the exhaust gas to a predetermined pressure (e.g., substantially an ambient pressure), wherein the exhaust pressure reducing chamber has an introduction port through which the exhaust gas from an exhaust pipe located on an upstream side in the flow of the exhaust gas flows into the exhaust pressure reducing chamber, and a discharge port through which the exhaust gas inside the exhaust pressure reducing chamber is discharged to an ambient side.

In accordance with the exhaust outlet equipment of the small watercraft so structured, since the exhaust pressure reducing chamber is provided at the downstream end portion of the exhaust passage so as to have the volume sufficient to reduce the pressure of the exhaust gas to the predetermined pressure (e.g., approximately ambient pressure), the exhaust gas expands at a high expansion rate inside the exhaust pressure reducing chamber, and is thereby muffled effectively. Because of the large volume of the exhaust pressure reducing chamber, a high back pressure is not applied to the exhaust passage. Therefore, an engine power is not greatly reduced by the exhaust pressure reducing chamber. Thus, the exhaust noise of the exhaust gas is muffled inside the watercraft, and hence is effectively muffled.

Preferably, the discharge port may communicate with the ambient side through a transom board of the watercraft to allow the exhaust gas inside the exhaust pressure reducing chamber to be discharged rearwardly of the transom board.

Preferably, the discharge port may communicate with a pump room of the water jet pump that opens toward the ambient side to allow the exhaust gas to be discharged outside the watercraft through the pump room. When the exhaust gas is brought into contact with the water inside the pump room, energy of the exhaust gas is absorbed. This facilitates muffling.

Preferably, a resonator may be provided on the exhaust pressure reducing chamber. The resonator is capable of muffling more effectively. In particular, by providing a resonator having a characteristic according to a frequency range of the noise to be muffled, the exhaust noise in this frequency range can be muffled effectively. Further, by providing a branch-type resonator corresponding to plural frequency ranges, exhaust noises in the corresponding plural frequency ranges can be muffled effectively.

Preferably, the resonator may be provided above the exhaust pressure reducing chamber, and a communicating port for dropping water within the resonator, may be provided on a lower portion of the resonator to allow the resonator and the exhaust pressure reducing chamber to communicate with each other. Through the communicating port, the water within the resonator drops into the inside of the exhaust pressure reducing chamber and is discharged outside the watercraft together with the exhaust gas.

Preferably, a first bellows valve may be attached to the introduction port so as to open toward an inside of the exhaust pressure reducing chamber by an exhaust pressure of the exhaust gas. Since the exhaust gas (exhaust noise) is brought into contact with the first bellows valve, it can be muffled more effectively.

Preferably, a second bellows valve may be attached to the discharge port so as to open toward the ambient side by the exhaust pressure of the exhaust gas. Since the exhaust noise that has been muffled inside the exhaust pressure reducing chamber is brought into contact with the second bellows valve, it can be muffled more effectively. In addition, since the exhaust pressure reducing chamber is substantially separated from the ambient side by the second bellows valve, the exhaust noise is muffled effectively.

Preferably, the second bellows valve may be provided with a slit. The slit allows the exhaust noise to be muffled effectively and substantially inhibits an increase in the back pressure inside the exhaust passage.

According to the present invention, there is provided a pipe mounting structure comprising a pipe attached to a wall having a first smooth wall face and a second rough wall face so as to penetrate through the wall such that a first (downstream, in the small watercraft) end of the pipe is located on the first wall face side and a second (upstream, in the watercraft) end of the pipe is located on the second wall face side, the pipe including a flange portion in contact with the second wall face on the second end side, and a reduced-diameter portion penetrating the wall to extend from the flange portion to the first end of the pipe, the reduced-diameter portion having a female screw on an inner peripheral face thereof; a fixing member attached to the first end of the pipe, the fixing member including a screw-engagement portion provided with a male screw to be attached to the female screw on an outer peripheral face thereof, and a flange portion having a large-diameter portion extending radially from the screw-engagement portion so as to have an outer diameter larger than an outer diameter of the first end of the pipe; and a seal member provided between the first wall face and the flange portion of the fixing member, wherein the pipe is attached to the wall in such a manner that the screw-engagement portion of the fixing member is screwed to the female screw of the first end of the pipe with the wall and the seal member held between the flange portion of the pipe and the fixing member.

In accordance with the above pipe mounting structure, the seal member is provided between the first smooth wall face and an opposing face of the fixing member in such a manner that the seal member is provided around a hole of the first wall face through which the pipe is inserted and the pipe penetrating through the wall to extend from the second wall face side to the first wall face side is fixed on the first wall face side by means of the fixing member, thereby sealing between the hole and the pipe. The fixing member is attached to the pipe by means of the female screw and the male screw, and these members are substantially sealed. In this case, seal tape or the like may be used to seal the screw-engagement portion as desired.

Preferably, the flange portion may be formed to include a step portion obtained by reducing a diameter of the first end portion of the pipe. The step portion makes the entire pipe an integrated unit. Consequently, favorably, the pipe gains high rigidity.

Preferably, the pipe mounting structure may further comprise an O-ring for sealing between the first end of the pipe, and the fixing member in contact with the first end. In this structure, the pipe and the fixing member are perfectly sealed without the use of the seal tape or the like attached to the screw-engagement portion.

Preferably, the first wall face may be an outer face of a body of the small watercraft and the pipe may be an exhaust pipe of the watercraft.

Preferably, the pipe mounting structure may further comprise an intermediate member provided between the seal member and the fixing member so as to have faces in contact with the seal member and the large-diameter portion of the flange portion of the fixing member.

The above and further objects and features of the invention will be more fully be apparent from the following detailed description with accompanying drawings.

DETAILED DESCRIPTION OF THE PREFERRED EMBODIMENTS

Hereinafter, embodiments of an exhaust outlet equipment of a personal watercraft according to the present invention, which is one type of small watercraft, will be described. The present invention is applicable to small watercraft other than the personal watercraft.

Figure 15:
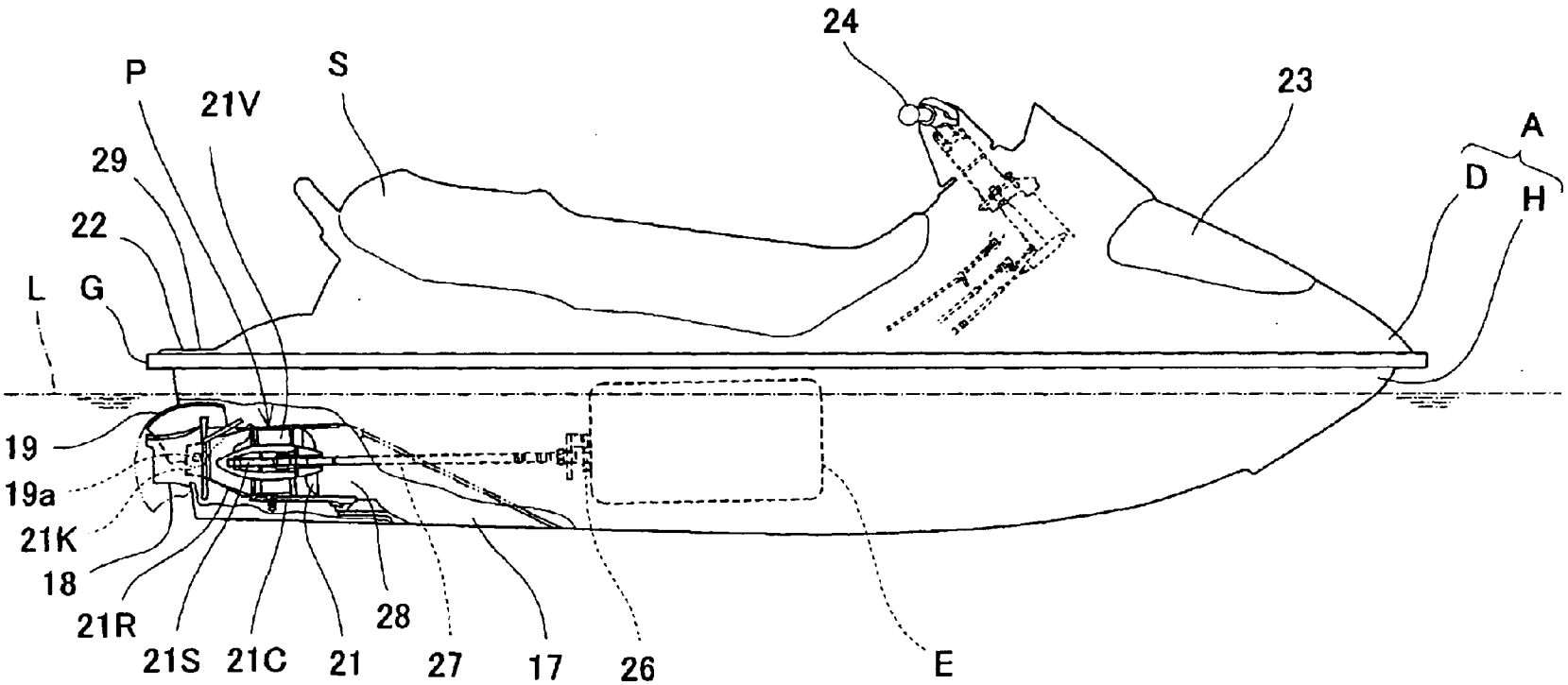
FIG. 15 is a side view showing an entire jet-propulsion personal watercraft according to the embodiment of the present invention.
Figure 16:
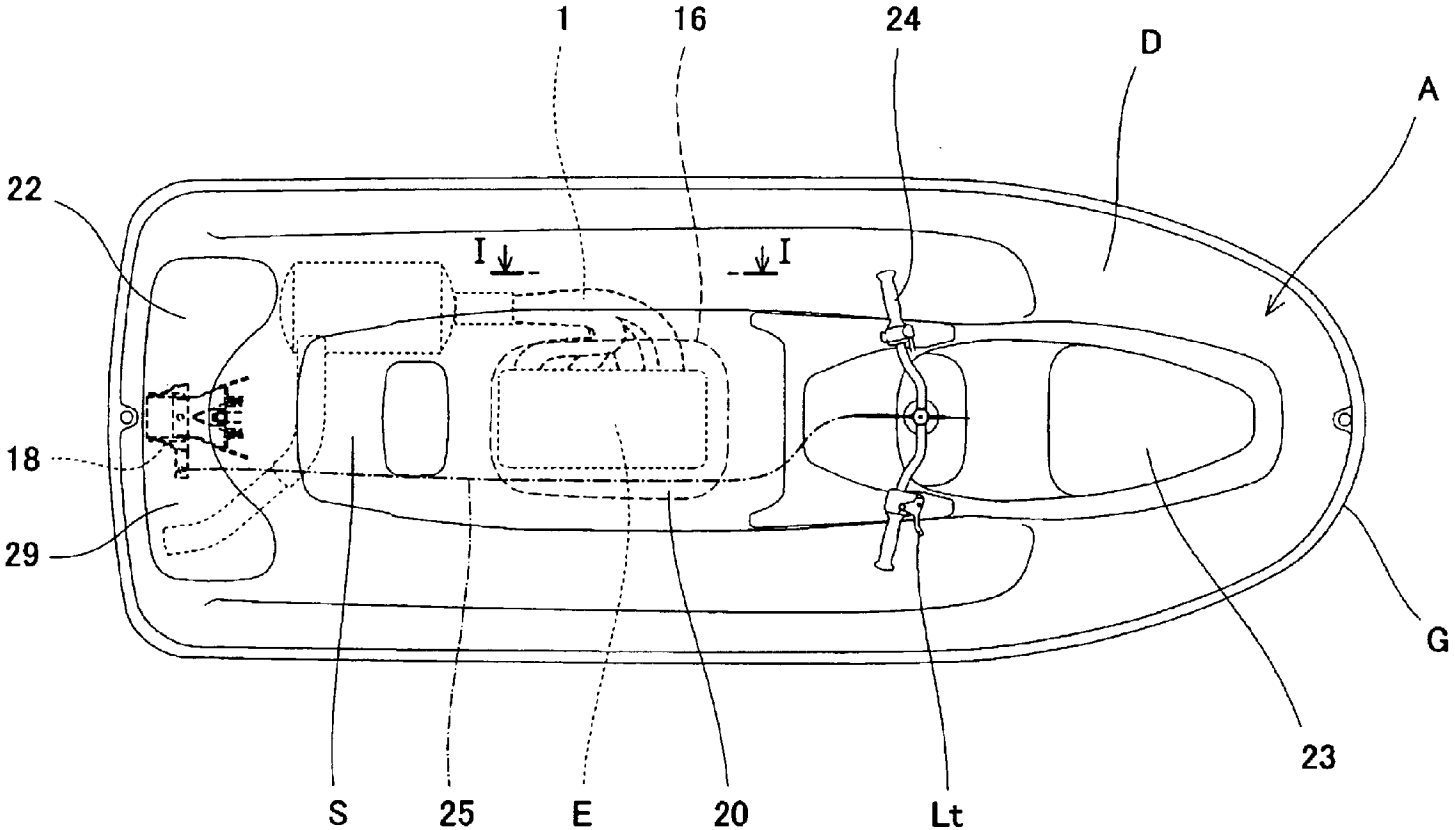
FIG. 16 is a plan view showing the entire personal watercraft in FIG. 15.

In FIGS. 15 and 16, reference numeral A denotes a body of the personal watercraft. The body A comprises a hull A and a deck D covering the hull H from above. A line at which the hull H and the deck D are connected over the entire perimeter thereof is called a gunnel line G. The gunnel line G is located above the waterline L of the personal watercraft.

As shown in FIG. 16, an opening 16, which has a substantially rectangular shape seen from above, is formed at a relatively rear section of the deck D such that it extends in the longitudinal direction of the body A, and a riding seat S is mounted above the opening 16 such that it covers the opening 16 from above as shown in FIGS. 15 and 16.

An engine E is contained in a chamber (engine room) 20 surrounded by the hull H and the deck D below the seat S and having a convex shape in a cross section of the body A. In this embodiment, the engine E is a multi-cylinder (e.g., four-cylinder) four-cycle engine. As shown in FIG. 15, the engine E is mounted such that a crankshaft 26 extends along the longitudinal direction of the body A. An output end of the crankshaft 26 is rotatably coupled integrally with a pump shaft 21S of a water jet pump P through a propeller shaft 27. An impeller 21 is mounted on the output shaft 21S of the water jet pump P. The impeller 21 is covered with a pump casing 21C on the outer periphery thereof. A water intake 17 is provided on the bottom of the hull H. The water is sucked from the water intake 17 and fed to the water jet pump p through a water intake passage 28. The water jet pump P pressurizes and accelerates the water. The pressurized and accelerated water is discharged through a pump nozzle 21R having a cross-sectional area of flow gradually reduced rearward, and from an outlet portion 21K provided on the downstream end of the pump nozzle 21R, thereby obtaining the propulsion force.

In FIG. 15, reference numeral 21V denotes fairing vanes for fairing water flow inside the water jet pump P. As shown in FIGS. 15 and 16, reference numeral 24 denotes a bar-type steering handle. By operating the steering handle 24 to the right or to the left, the steering nozzle 18 provided behind the pump nozzle 21R swings to the right or to the left through a wire cable 25 represented by a dashed line in FIG. 16. The watercraft can be turned to any desired direction while the water jet pump P is generating the propulsion force. In FIG. 16, a throttle lever Lt serves to adjust an engine speed of the engine E.

As shown in FIG. 15, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward and, as the resulting reaction, the personal watercraft moves rearward.

In FIGS. 15 and 16, reference numeral 22 denotes a rear deck. The rear deck 22 is provided with an operable hatch cover 29. A rear compartment (not shown) with a small capacity is provided under the hatch cover 29. Reference numeral 23 denotes a front hatch cover. A front compartment (not shown) is provided under the front hatch cover 23 for storing equipment and the like.

(Embodiment 1)

Figure 1:
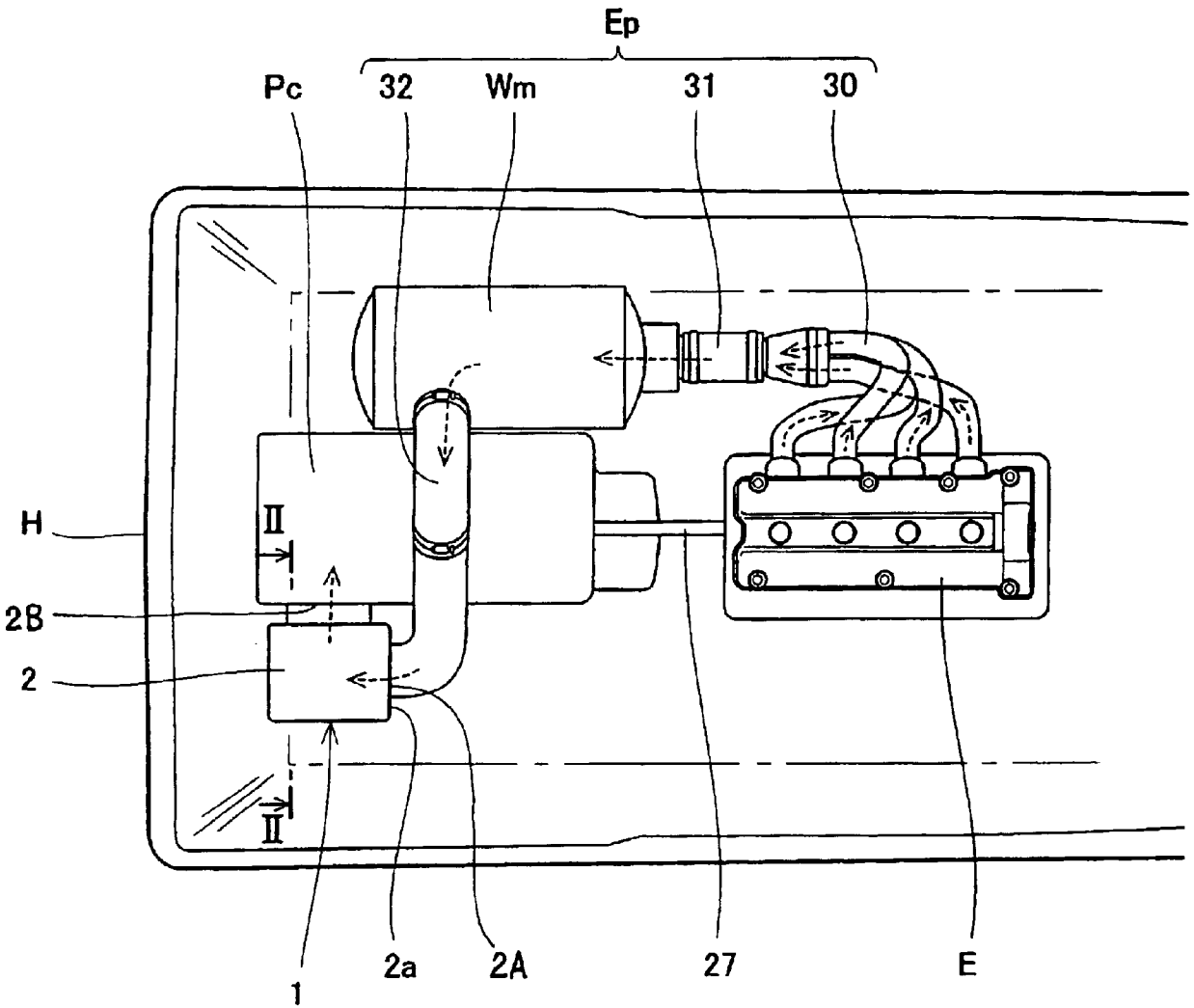
FIG. 1 is a view of a rear portion of a jet-propulsion personal watercraft according to an embodiment of the present invention, showing a structure for mounting an exhaust outlet equipment to a body, with a deck cut away.

As shown in FIG. 1, the engine E, an exhaust passage Ep, and the like are mounted on an inside of the hull H. The exhaust passage Ep is provided on exhaust ports of the engine E to allow an exhaust gas generated in the engine E to be discharged therethrough, to outside the watercraft. As shown in FIG. 1, the exhaust passage Ep comprises exhaust manifolds 30 having upstream ends connected to exits of the exhaust ports of the engine E, a first exhaust pipe 31 connected to a downstream end of the exhaust manifold 30, a water muffler Wm connected to a downstream end of the first exhaust pipe 31, and a second exhaust pipe 32 for leading the exhaust gas from the water muffler Wm outside the watercraft. An exhaust outlet equipment 1 is provided on a downstream end of the second exhaust pipe 32, i.e., a downstream end of the exhaust passage Ep. In FIG. 1, an arrow represented by a broken line indicates a schematic flow of the exhaust gas.

As shown in FIGS. 1 to 4, the exhaust outlet equipment 1 has an exhaust pressure reducing chamber 2 having a volume (capacity) to reduce a pressure of the exhaust gas to a predetermined pressure (e.g., approximately an ambient pressure). In this embodiment, when the engine E (see FIG. 1) has a displacement of 1.3 liters, the exhaust pressure reducing chamber 2 has a volume of at least substantially 2 to 4 liters. Preferably, the volume of the exhaust pressure reducing chamber 2 is maximized so as to increase a muffling effect and so as not to increase the back pressure of the exhaust system. More specifically, the exhaust pressure reducing chamber 2 is non-equilateral pentagon shaped in a cross-sectional view (see FIG. 2) and is rectangular-box shaped as shown in FIG. 1 in a plan view.

As shown in FIGS. 1 to 4, an introduction port 2A is formed on a side wall 2*a* of the exhaust pressure reducing chamber 2 (front side wall in this embodiment) so as to communicate with the downstream end of the exhaust pipe 32. Through the introduction port 2A, the exhaust gas from the engine E flows into the exhaust pressure reducing chamber 2. Further, a discharge port 2B is formed on a side wall of the exhaust pressure reducing chamber 2 (side wall on the side of a pump room P containing the water pump therein) to allow the exhaust gas to be discharged outside the watercraft.

Figure 2:
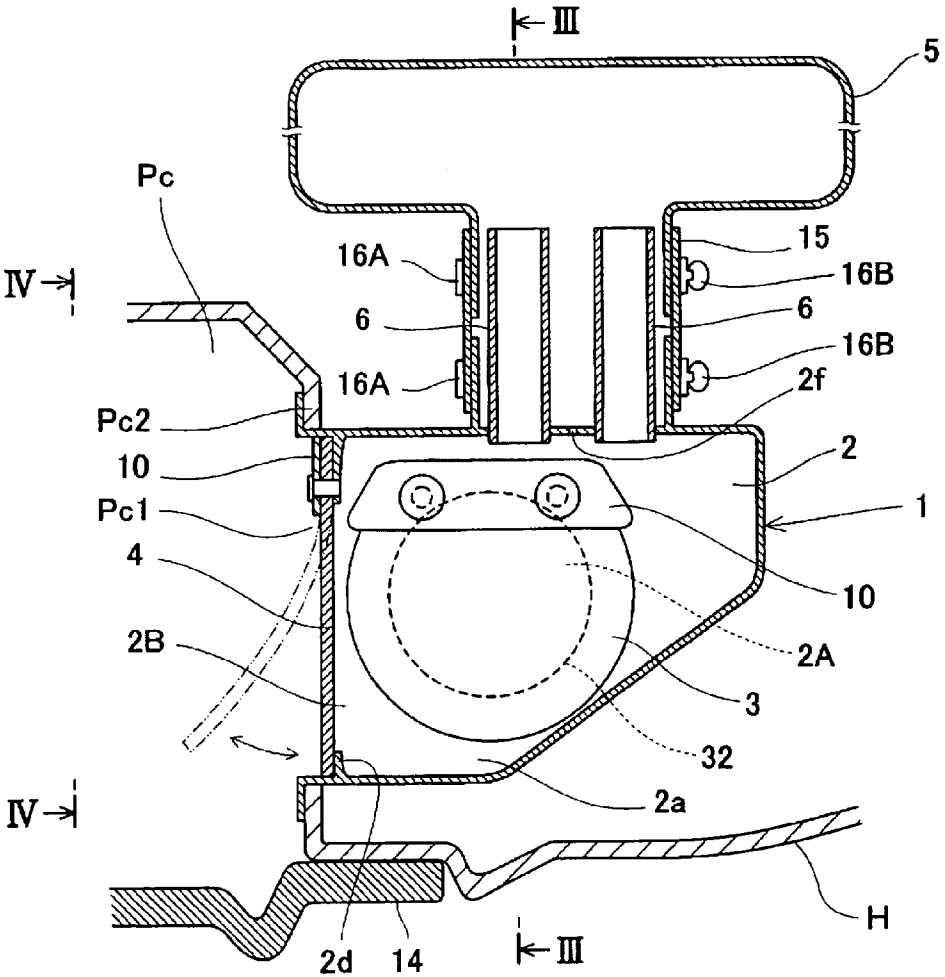
FIG. 2 is a cross-sectional view taken in the direction of arrows along line II—II in FIG. 1 or FIG. 3, showing a structure of the exhaust outlet equipment in FIG. 1.

As shown in FIG. 2, the exhaust pressure reducing chamber 2 is fixed to a side wall face Pc 2 of the pump room P such that the discharge port 2B conforms to an opening portion Pc1 formed in the pump room Pc. The exhaust gas flows into an inside of the pump room Pc through the discharge port 2B. Then, the exhaust gas flows through the inside of the pump room Pc and is discharged outside the watercraft.

Figure 3:
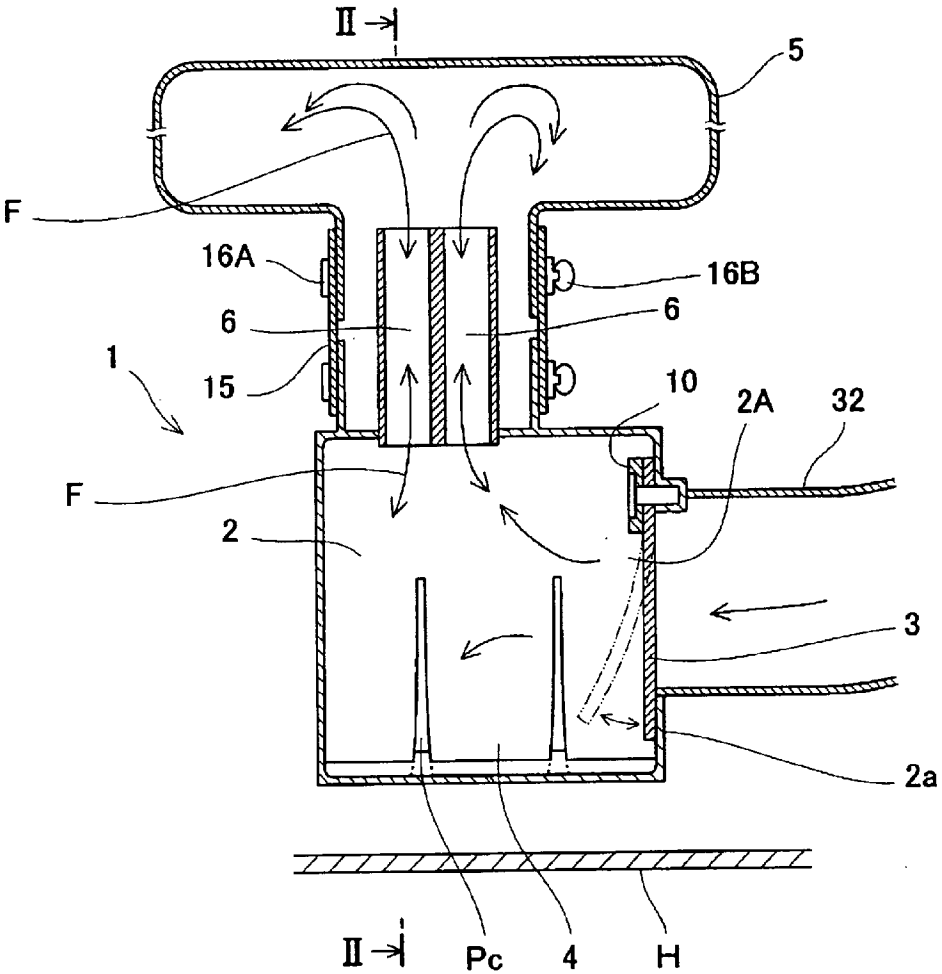
FIG. 3 is a cross-sectional view taken in the direction of arrows along line III—III in FIG. 2.

As shown in FIG. 3, a rubber bellows valve 3 as a first bellows valve is provided at the introduction port 2A in such a manner that a portion except a mounting portion at an upper end thereof is swung around the mounting portion so as to open toward an inside of the exhaust pressure reducing chamber 2 by an exhaust pressure of the exhaust gas. In FIG. 3, an arrow F indicates a schematic flow of the exhaust gas inside the exhaust gas pressure reducing chamber 2 and its vicinity.

Figure 4:
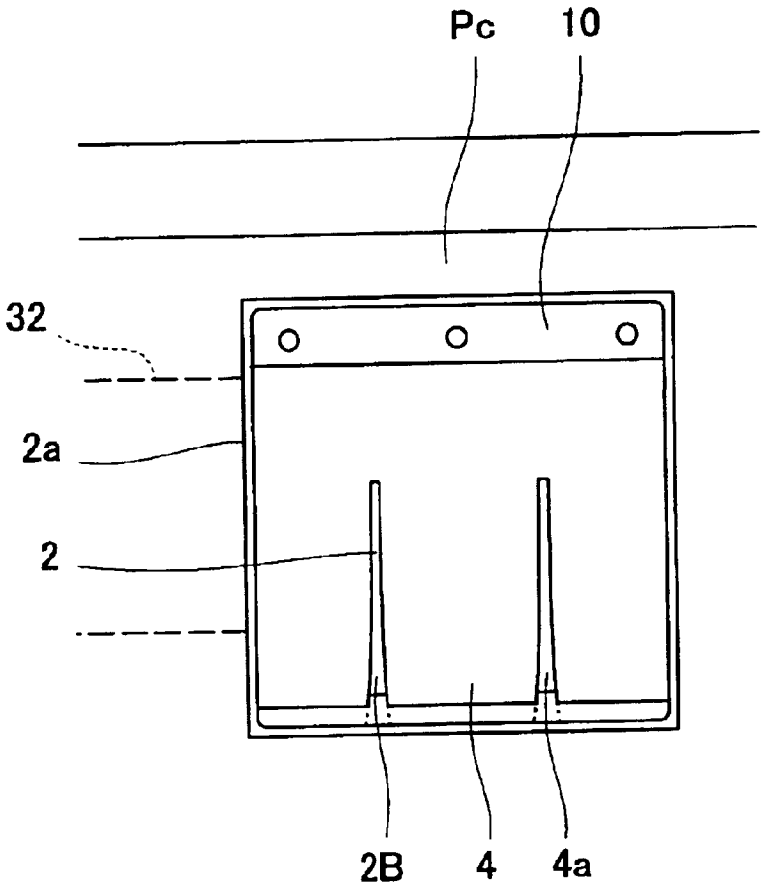
FIG. 4 is a cross-sectional view taken in the direction of arrows along line IV—IV in FIG. 2.

As shown in FIG. 2, a rubber bellows valve 4 as a second bellows valve is provided at the discharge port 2B in such a manner that a portion except a mounting portion at an upper end thereof is swung around the mounting portion so as to open toward the pump room Pc by the exhaust pressure. As shown in FIG. 4, when the exhaust pressure reducing chamber 2 is seen from the side of the pump room Pc, the bellows valve 4 has slits 4*a* extending from a lower end to a substantially center in the vertical direction. The slits 4*a* allow an inside of the exhaust pressure reducing chamber 2 to communicate with an inside of the pump room Pc.

The bellows valve 3 and the bellows valve 4 may be formed of a heat-resistant rubber, for example, NBR or PVC. It is desirable to form minute concave and convex portions on surfaces of the valves 3 and 4 to absorb the exhaust noise.

As shown in FIGS. 2 and 3, a resonator 5 is provided above the exhaust pressure reducing chamber 2. The resonator 5 is connected to the exhaust pressure reducing chamber 2 through a connecting pipe 6 as a communicating passage. In this embodiment, a lower end of the connecting pipe 6 is located lower than a lower end of the resonator 5 under the condition in which the watercraft is at a normal position.

A frequency range of the exhaust noise to be muffled by the resonator 5 can be changed by changing the length and cross-sectional area of the connecting pipe 6. In addition, the frequency range of the exhaust noise to be muffled by the resonator 5 and the muffling effect can be changed by changing the volume of the resonator 5. In this embodiment, the volume of the resonator 5 is set to substantially 2 to 3 liters.

As shown in FIG. 2, in this embodiment, an opening 2*f* having a small diameter is formed in an upper wall face of the exhaust pressure reducing chamber 2 provided with the resonator 5 to allow water within the resonator 5 to flow downwardly into an inside of the exhaust pressure reducing chamber 2.

Figure 5:
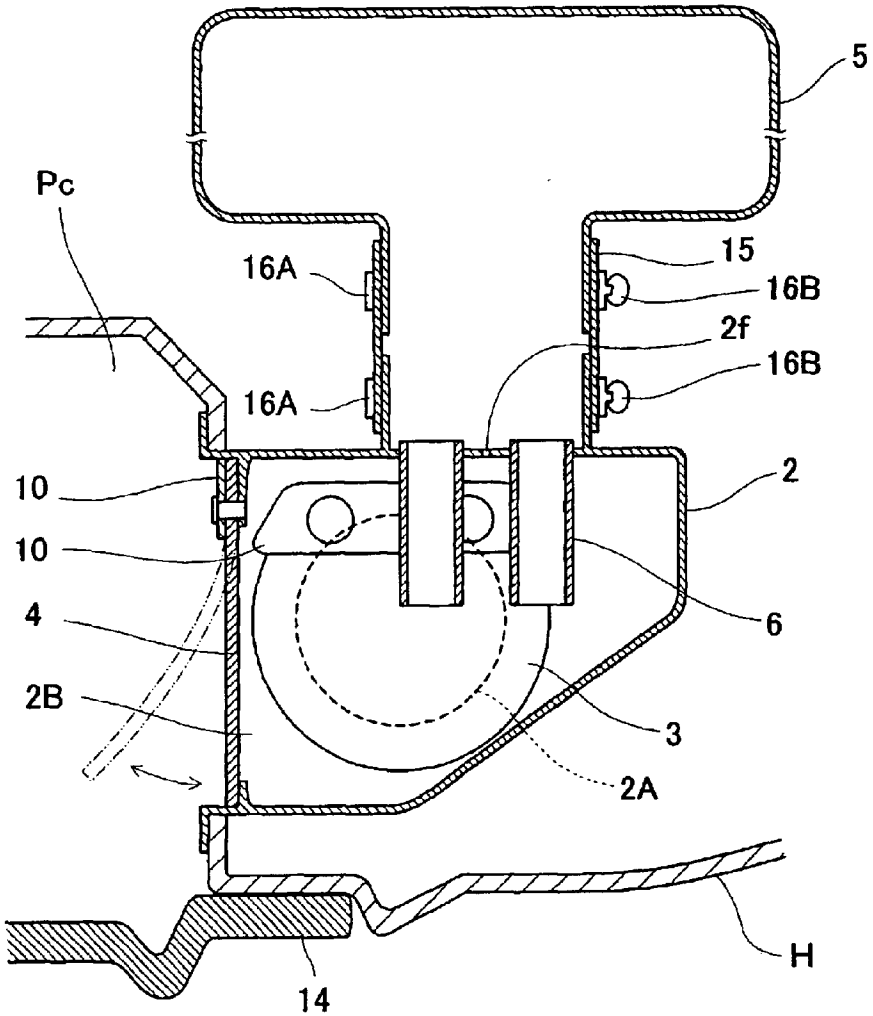
FIG. 5 is a cross-sectional view showing an exhaust outlet equipment according to another embodiment, in which a connecting pipe in FIG. 2 is placed in an exhaust pressure reducing chamber in FIG. 2 in a different manner.

As shown in FIG. 5, the connecting pipe 6 may be positioned so that an upper end thereof is substantially as high as an upper wall face of the exhaust pressure reducing chamber 2 and a lower end thereof is located at substantially the center of the exhaust pressure reducing chamber 2. In FIG. 5, the same reference numerals as those in FIGS. 2 to 4 denote the same or corresponding parts.

In FIGS. 2 to 5, a grating member 14 is disposed on a bottom surface of the pump room Pc to define the pump room Pc. A rubber tube 15 is configured to connect the exhaust pressure reducing chamber 2 to the resonator 5 in a sealed state. Steel bands 16A are configured to fix the rubber tube 15. Fixing members 16B are configured to fix the steel bands 16A.

In accordance with the exhaust outlet equipment 1 configured as described above, the following function and effects are obtained. The exhaust gas from the engine E flows through the second exhaust pipe 32 and then into the exhaust pressure reducing chamber 2. At this time, the exhaust gas is brought into contact with the bellows valve 3 openably provided on the introduction port 2A of the exhaust pressure reducing chamber 2, so that energy of the exhaust gas is partially absorbed and the exhaust gas is muffled. In this case, when the bellows valve 3 is made of rubber and is provided with minute concave and convex portions on a surface thereof, the exhaust noise is absorbed by the bellows valve 3. In addition, the exhaust gas expands at a high expansion rate inside the exhaust pressure reducing chamber 2 having a volume sufficient to reduce the pressure of the exhaust gas to substantially equal the ambient pressure, so that the exhaust gas is muffled more effectively. Further, the exhaust noise in a desired frequency range is muffled by the resonator 5 provided on the exhaust pressure reducing chamber 2.

Then, the exhaust gas is discharged from the discharge port 2B of the exhaust pressure reducing chamber 2 into the pump room Pc. At this time, the exhaust gas makes contact with the bellows valve 4 and is further muffled. The exhaust noise is absorbed by the bellows valve 4 if it is made of rubber and provided with minute concave and convex portions.

During cruising, a high exhaust noise is generated, and water spray fills the inside of the pump room Pc. The exhaust noise is absorbed by the water spray and thereby, further muffled. Since the pump room Pc is surrounded by the hull H forming a wall face of the pump room Pc, except a rear portion, and the water spray fills the rear of an opening portion formed at the rear end of the pump room, which opens on the ambient side and, thereby, the noise is muffled.

Preferably, plate springs 10 are provided at upper ends of the bellows valve 3 and the bellows valve 4 so as to inhibit opening of these valves 3 and 4 by their spring forces and reinforce fixation of the valves 3 and 4.

(Embodiment 2)

Figure 6:
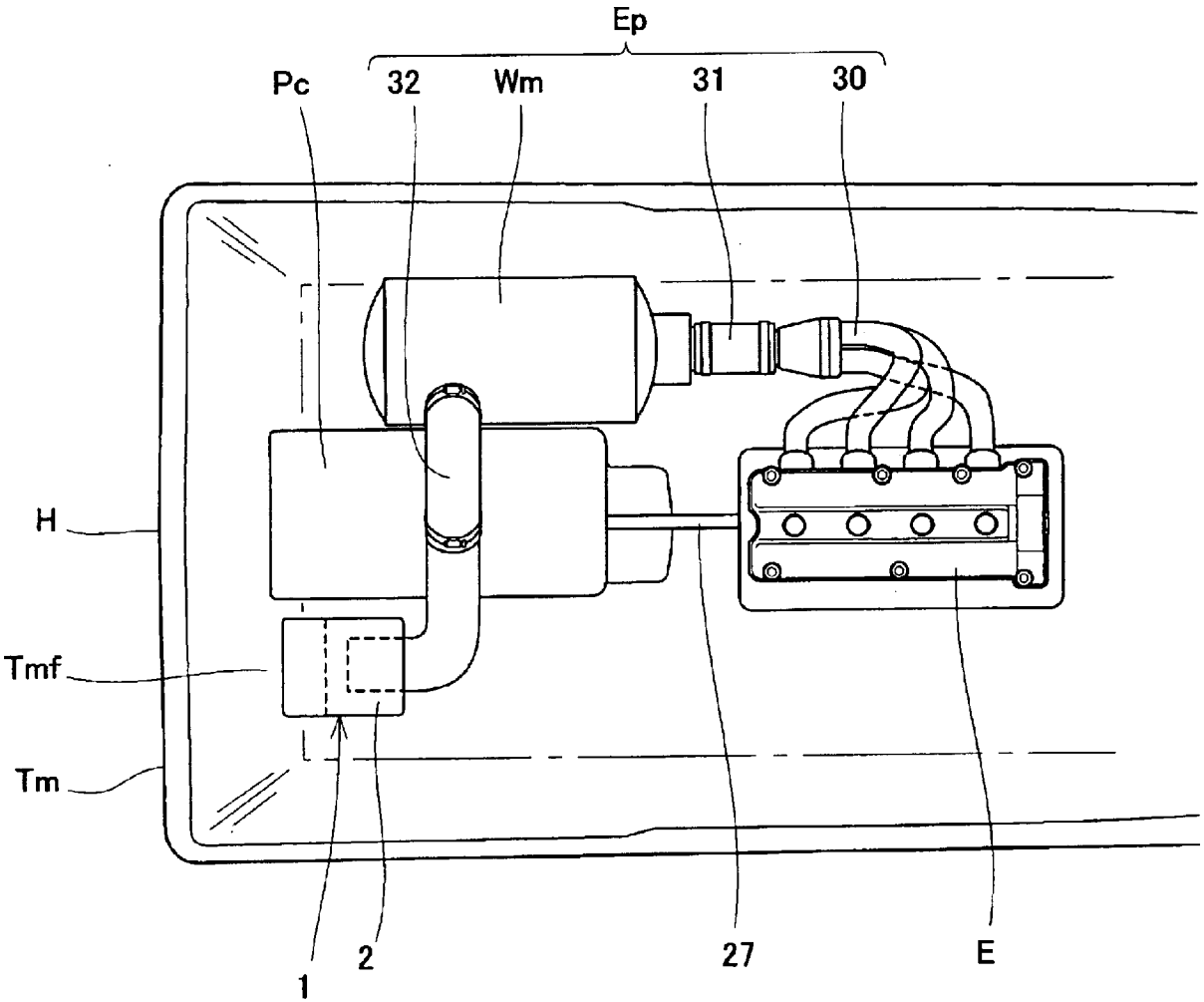
FIG. 6 is a view of a rear portion of a jet-propulsion personal watercraft according to a second embodiment of the present invention, showing a structure for mounting the exhaust outlet equipment to the body, with a deck cut away.

A second embodiment of the present invention will be described with reference to FIGS. 6 to 8. In the second embodiment, the exhaust pressure reducing chamber 2 of the exhaust outlet equipment 1 is provided at a location forward of the transom board Tm to be adjacent a front face (inner side face) of the transom board Tm of the watercraft. The exhaust pressure reducing chamber 2 has a volume (capacity) sufficient to reduce the pressure of the exhaust gas to an approximately ambient pressure. Specifically, in this embodiment, when the displacement of the engine E (see FIG. 6) is 1.3 liters, the exhaust pressure reducing chamber 2 has a volume of about 2 to 4 liters. The volume of the exhaust pressure reducing chamber 2 is maximized so as to increase the muffling effect and so as not to increase the back pressure of the exhaust system.

Figure 7:
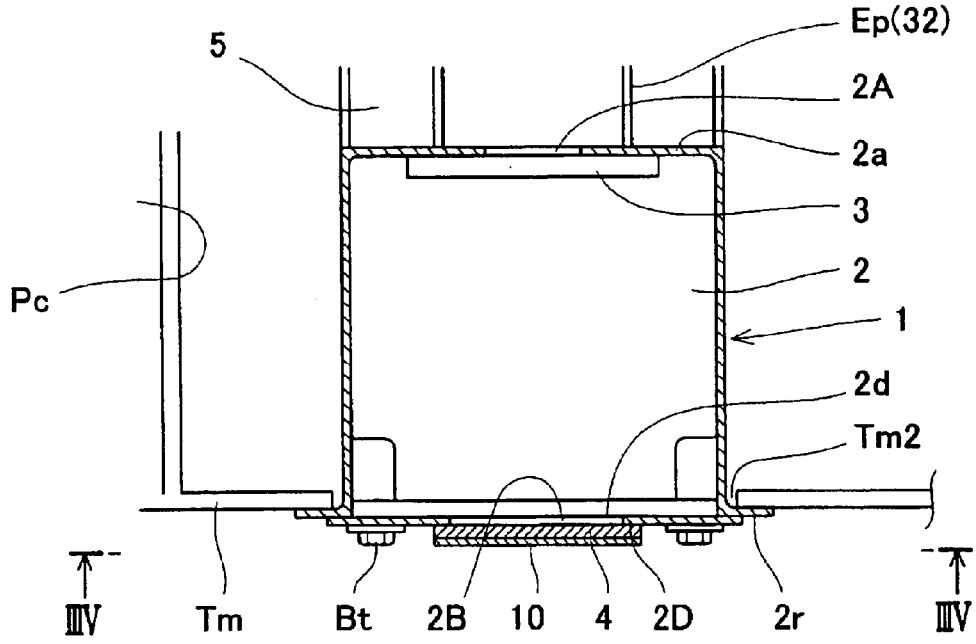
FIG. 7 is a cross-sectional view taken in the direction of arrows along line IIV—IIV in FIG. 8, showing a structure of the exhaust outlet equipment in FIG. 6.

As shown in FIG. 7, the introduction port 2A is formed on the front side wall 2*a* of the exhaust pressure reducing chamber 2, and the downstream end of the exhaust passage Ep extending from the engine E, i.e., the downstream end of the second exhaust pipe 32, is connected to the introduction port 2A to allow the exhaust gas to flow into the exhaust pressure reducing chamber 2.

In this embodiment, the discharge port 2B is formed on the rear side of the exhaust pressure reducing chamber 2. The discharge port 2B is located in an opening Tm2 formed in the transom board Tm to allow the exhaust gas from an inside of the exhaust pressure reducing chamber 2 to be discharged outside the watercraft through the discharge port 2B.

Figure 8:
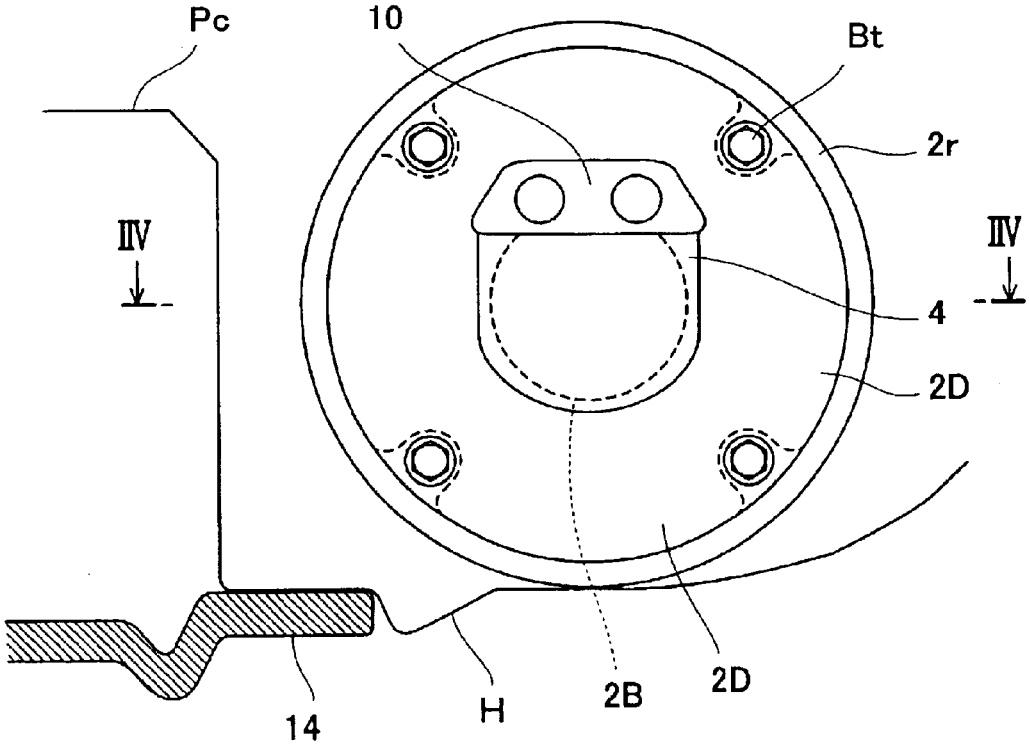
FIG. 8 is a cross-sectional view taken in the direction of arrows along line IIIV—IIIV in FIG. 7.

In this embodiment, as shown in FIG. 7 or 8, a flange portion 2*r* is provided at a rear end of the exhaust pressure reducing chamber 2 so as to protrude outwardly. The flange portion 2*r* is configured to engage with a periphery of the opening Tm2 of the transom board Tm. A circular plate 2D is provided with an opening serving as the discharge port 2B at a center thereof and is attached to the flange portion 2*r* by means of four bolts Bt provided on a peripheral portion thereof. The circular plate 2D forms a rear end wall of the exhaust pressure reducing chamber 2.

As shown in FIG. 7, the rubber bellows valve 3 as a first bellows valve is provided at the introduction port 2A in such a manner that a portion except a mounting portion at an upper end thereof is swung around the mounting portion to open toward the inside of the exhaust pressure reducing chamber 2 by the exhaust pressure as in the first embodiment. The bellows valve 3 and its mounting structure are identical to those of the first embodiment in FIG. 2.

As shown in FIG. 7 or 8, the rubber bellows valve 4 as a second bellows valve is provided at the discharge port 2B in such a manner that a portion except a mounting portion at an upper end thereof is swung around the mounting portion to open toward the ambient side of the watercraft by the exhaust pressure. The bellows valve 4 of this embodiment is not provided with a slit described in the first embodiment. The bellows valve 4 and the bellows valve 3 are made of the same material. The bellows valve 4 and its mounting structure are basically the same as the bellows valve 3 of the first embodiment in FIG. 2. In FIGS. 7 and 8, reference numeral 10 denotes plate springs. The plate springs 10 serve to inhibit opening of the valves 3 and 4 by their spring forces and reinforce fixation of the valves 3 and 4. Preferably, the plate springs 10 are provided at upper end portions of the bellows valve 3 and the bellows valve 4.

Figure 9:
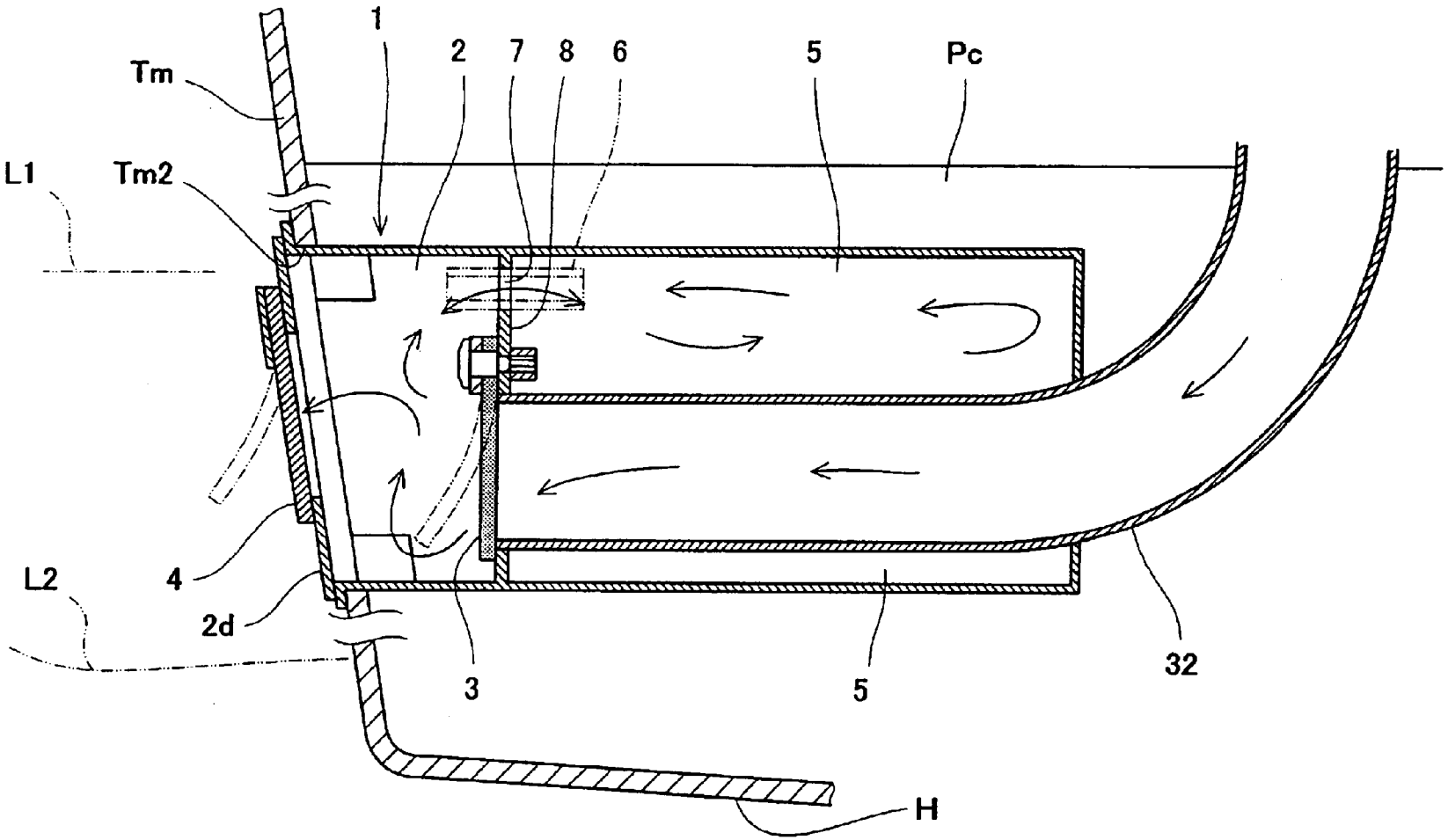
FIG. 9 is a cross-sectional view showing an internal structure of the exhaust outlet equipment in FIG. 5 excluding a resonator, which is sectioned along the longitudinal direction of the watercraft.

As shown in FIG. 9, in this embodiment, the resonator 5 is provided integrally with the exhaust pressure reducing chamber 2 and adjacent the front part of the exhaust pressure reducing chamber 2 (in FIG. 9, right side). More specifically, the resonator 5 is configured such that a tubular outer peripheral wall of the exhaust pressure reducing chamber 2 is extended forward so as to accommodate the downstream end portion of the second exhaust pipe 32. In other words, the downstream end portion of the second exhaust pipe 32 and the outer peripheral wall of the resonator 5 form a double-walled structure.

An opening 7 as a communicating port is provided on a separating wall 8 that defines the exhaust pressure reducing chamber 2 and the resonator 5. Depending on the size of the opening 7, a frequency range of the exhaust noise capable of being muffled by the resonator 5 varies. In addition, depending on the volume of the resonator 5, the frequency range and a muffling effect varies. In this embodiment, the resonator 5 has a volume of about 5 to 9 liters. The connecting pipe 6 is inserted through the opening 7 as represented by a two-dotted line.

The exhaust outlet equipment 1 configured as described above is capable of muffling without substantially increasing the back pressure, as in the first embodiment. In addition, since the resonator 5 is provided integrally with the exhaust pressure reducing chamber 2, a simple configuration is gained. In assembly, the exhaust pressure reducing chamber 2 provided with the resonator 5 is inserted toward the front through the opening Tm2 formed in the transom board Tm and mounted on the body A (hull H).

As described above, since the rear end wall 2D of the exhaust pressure reducing chamber 2 is removably attached, the bellows valve 3 located within the exhaust pressure reducing chamber 2 can be changed easily merely by removing bolts Bt (see FIG. 8). In FIG. 9, L1 denotes a waterline of the watercraft at rest and L2 denotes a waterline of the watercraft in a cruising state.

(Embodiment 3)

Figure 14:
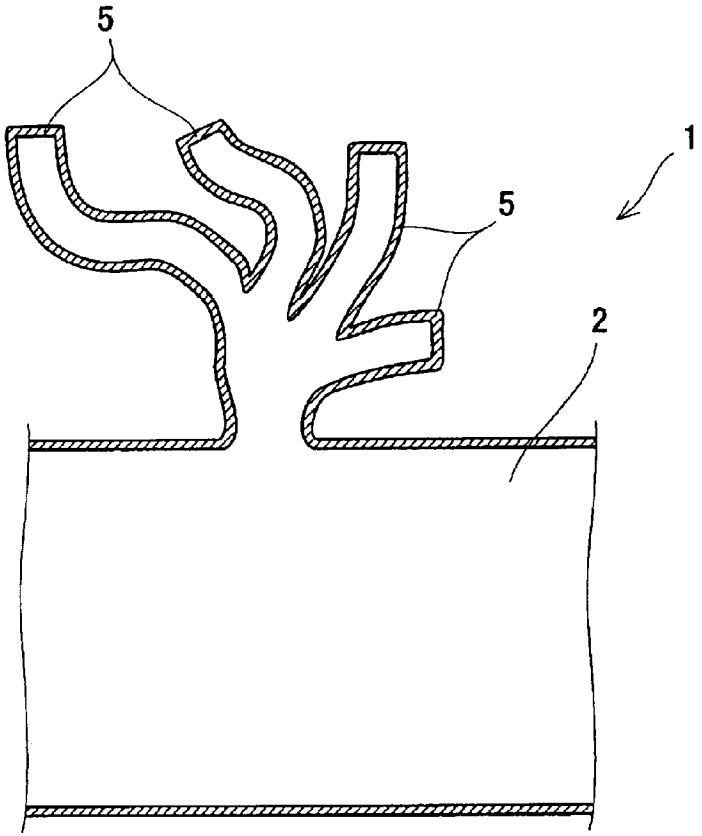
FIG. 14 is a cross-sectional view showing main components of an exhaust outlet equipment, showing a schematic structure of a branch resonator.

Referring to FIG. 14, a resonator 5 of a branch pipe type is provided on the exhaust pressure reducing chamber 2. This resonator 5 is capable of effectively muffling exhaust noises in plural frequency ranges.

(Embodiment 4)

Preferably, the discharge port 2B at the rear end of the exhaust outlet equipment 1 of the second embodiment is mounted to the body A as described below. In the case of a FRP body of the watercraft manufactured by hand lay-up or spray-up method, the inner surface 1*w* of the body of the watercraft is a rough surface. As shown in FIGS. 10 to 13, the discharge port 2B of the exhaust outlet equipment 1 is configured to have a reduced diameter to be formed into a step portion 2S. The step portion 2S, i.e., a connecting face 2*h* of the step portion 2S forms a flange portion.

Figure 10:
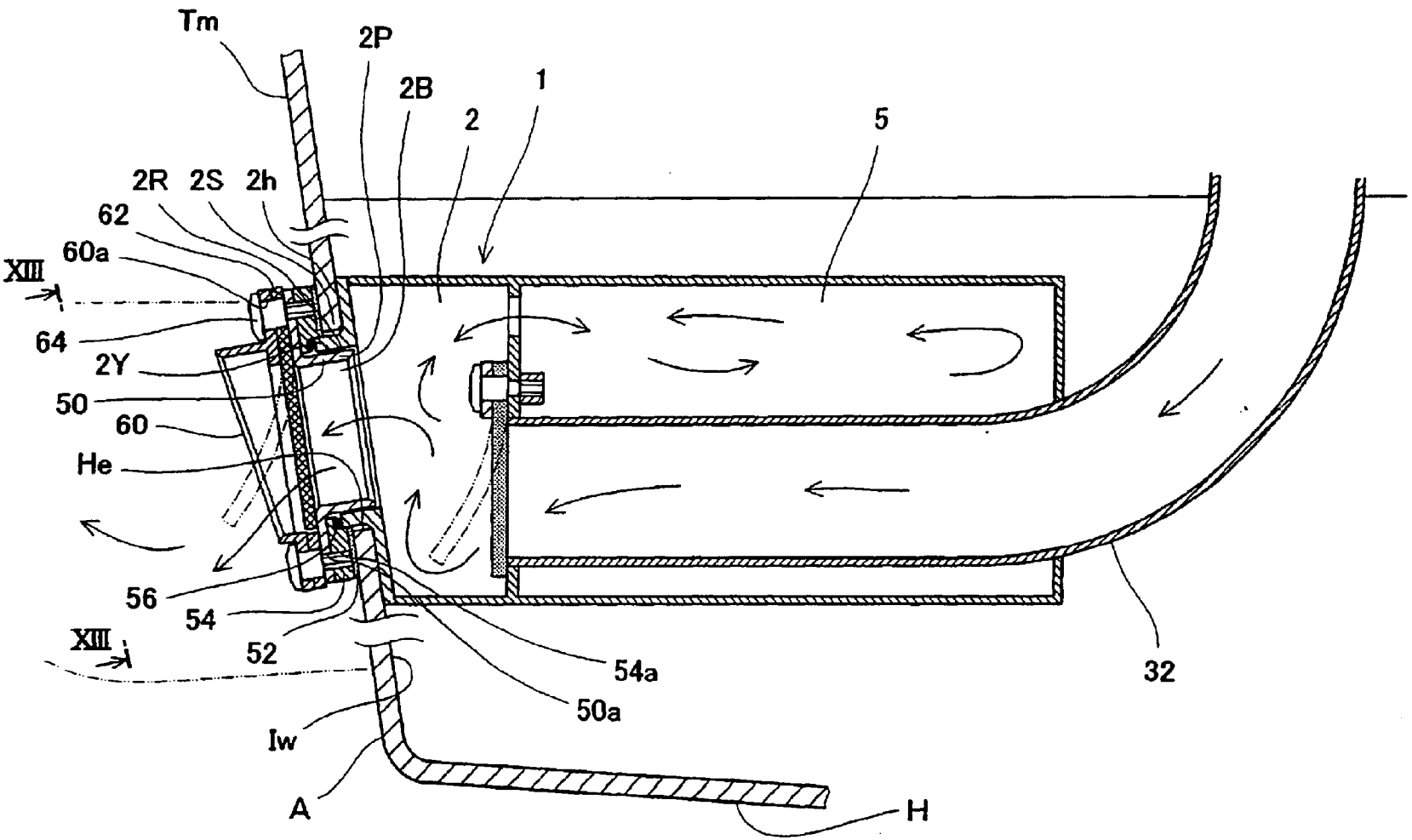
FIG. 10 is an enlarged side cross-sectional view showing a structure for mounting a pipe such as an exhaust pipe to the body of the personal watercraft.
Figure 11:
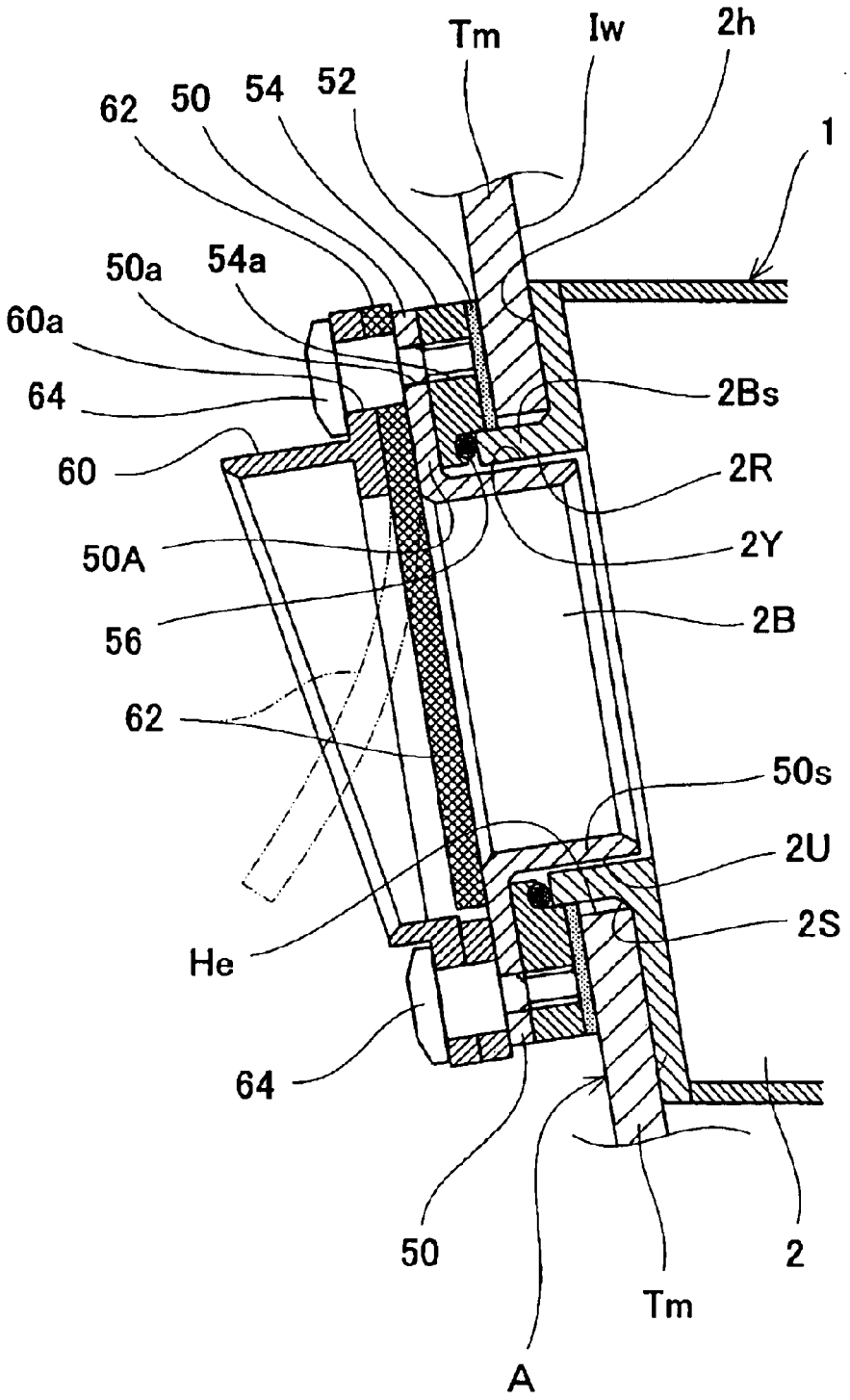
FIG. 11 is a partially enlarged cross-sectional view showing main components of the pipe mounting structure in FIG. 10.

As shown in FIG. 11, which is an enlarged view of main components in FIG. 10, a female screw 2R is formed on an inner peripheral face of a reduced-diameter portion 2Bs of the discharge port 2B. A through-hole He is formed on the body A so as to have an inner diameter substantially equal to or slightly larger than an outer diameter of the reduced-diameter portion 213*s*. Through the through-hole He, the reduced-diameter portion 2Bs of the discharge port 2B of the exhaust outlet equipment 1 is inserted. The reduced-diameter portion 2Bs is typically cylindrical but may be non-cylindrical; for example, tubular with rectangular cross-section, for precise positioning.

The discharge port 2B is fixed to the body A in such a manner that a fixing member 50 is screwed to the discharge port 2B. The fixing member 50 has a flange portion 50A and a reduced-diameter portion 50*s* having a male screw 2U to be attached to the female screw 2R of the discharge port 2B on an outer peripheral face 2Y thereof. That is, the discharge port 2B of the exhaust outlet equipment 1 is fixed to the body A in such a manner that the reduced-diameter portion 50*s* of the fixing member 50 is screwed to the reduced-diameter portion 2Bs of the discharge port 2B that penetrates through the body A to extend from inside to outside with the step portion 2S in contact with an inner face of the body A, from the direction of outside the body. In this fixing, a seal member 52 that is made of rubber and ring-shaped is provided in contact with an outer surface of the transom board Tm and an intermediate member 54 is provided on an outer side of the seal member 52. The flange portion 50A of the fixing member 50 formed on a downstream end side of the reduced-diameter portions 50*s* has a diameter larger than an outer diameter of the reduced-diameter portion 2Bs. With the fixing member 50 screwed to the discharge port 2B, the seal member 52 is pressed toward the inner surface of the transom board Tm, by the flange portion 50A of the fixing member 50, thereby enabling sealing between the transom board Tm and the intermediate member 54. In this structure, it is desirable to provide an O-ring 56 between the intermediate member 54 and a downstream end face of the reduced-diameter portion 2Bs of the discharge port 2B. With this structure, with the fixing member 50 screwed to the discharge port 2B, the O-ring 56 functions as seal between the intermediate member 54 and the discharge port 2B.

When the fixing member 50 is rotated to be screwed to the discharge port 2B fixed on the body A, unwanted rotational force does not act on the seal member 52 and the O-ring 56. This is due to the fact that, when the fixing member 50 and the intermediate portion 54, which are both made of resin or metal, are sliding in surface contact with each other, a coefficient of friction generated between these members is much lower than that of the seal member 52 and the intermediate portion 54 (and between the O-ring 56 and the intermediate member 54). Therefore, when the fixing member 50 is screwed to the discharge port 2B, the seal member 52 and the O-ring 56 produce a seal effect without being deformed or damaged.

With this structure, in the case where the body A is manufactured by hand lay-up method or the like and thereby has the rough inner surface 1*w*, a pipe extending from the body A to outside the watercraft, i.e., the reduced-diameter portion 2Bs of the discharge port 2B of the exhaust outlet equipment 1 can be mounted in a sealed state.

Figure 12:
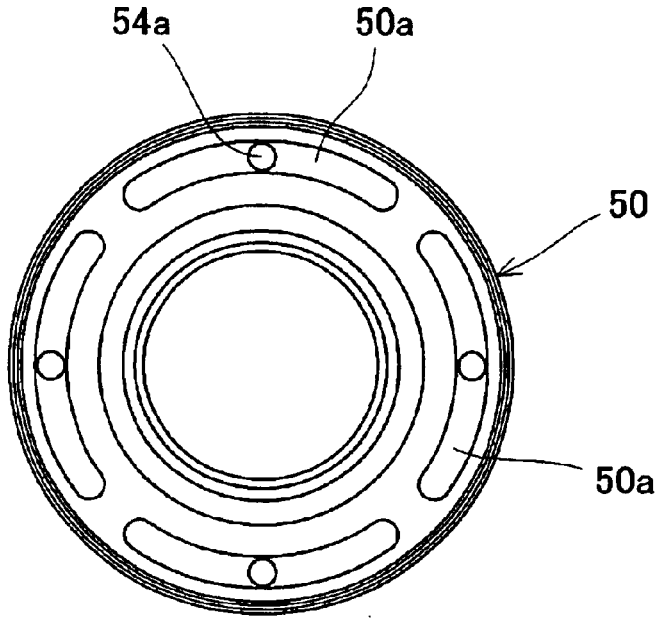
FIG. 12 is a rear view showing a structure of an intermediate member in FIG. 10 as seen from behind a transom board.

Further, in this embodiment, an exhaust end pipe 60 is provided continuously with and behind the fixing member 50. A plurality of elongate through-holes 50*a* (see FIG. 12) are formed in the fixing member 50, and a plurality of female screw holes 54*a* are formed in the intermediate member 54 so as to conform to the through-holes 50*a*. These holes are formed at four positions at intervals of 90 degrees. As shown in FIG. 10, 11, or 12, a bellows valve 62 is provided to be in surface contact with a rear end face of the fixing member 50. The bellows valve 62 is configured to have a center portion partially cut out to be opened and closed. Further, as shown in FIGS. 10 and 11, the exhaust end pipe 60 is provided behind the bellows valve 62. The exhaust end pipe 60 is configured such that a rear end of an upper end portion thereof rearwardly protrudes more greatly than a rear end of a lower end portion thereof. The exhaust end pipe 60 is provided with through-holes 60*a* respectively corresponding to the female screw holes 54*a* of the intermediate member 54. Through the through-holes 60*a*, fixing bolts 64 are inserted toward the intermediate member 54 and are screwed and fixed to the female screw holes 54*a*.

Figure 13:
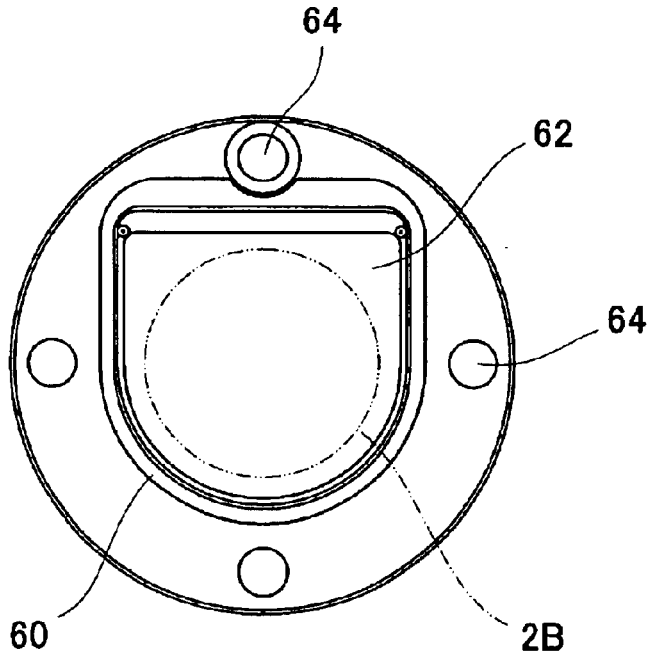
FIG. 13 is a view taken in the direction of arrows along line XIII—XIII in FIG. 10, showing the pipe mounting structure in FIG. 10 as seen in a rear view.

Thus, by positioning the exhaust end pipe 60 behind the fixing member 50, unburned carbon or the like contained in the exhaust gas is inhibited from adhering to the outer surface of the transom board Tm of the body A. FIG. 13 is a view taken in the direction of arrows along line XII—XII in FIG. 10, showing a structure of the exhaust end pipe 60 or the like, as seen from behind the transom board Tm.

The pipe mounting structure is applicable to a mounting structure of an air-intake port and a water discharge port, or other mounting structures of other general pipes (e.g., FRP bus unit or washing unit), in addition to the exhaust passage of the exhaust outlet equipment 1 described in the above embodiments.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An exhaust outlet equipment provided at a downstream end portion of an exhaust passage of a propulsion engine in a flow of an exhaust gas, the engine being mounted in a small watercraft propelled by a water jet pump, the equipment comprising:

an exhaust pressure reducing chamber provided laterally of a pump room that contains the water jet pump, the chamber having a volume for reducing a pressure of the exhaust gas to a predetermined pressure, wherein the exhaust pressure reducing chamber is provided at a rear end of the exhaust passage and has an introduction port through which the exhaust gas from an exhaust pipe located on an upstream side in the flow of the exhaust gas flows into the exhaust pressure reducing chamber, and a discharge port through which the exhaust gas inside the exhaust pressure reducing chamber is discharged to an ambient side of the hull, the discharge port contacting the ambient side of the hull.

2. The exhaust outlet equipment according to claim 1, wherein the discharge port communicates with the ambient side through a transom board of the watercraft to allow the exhaust gas inside the exhaust pressure reducing chamber to be discharged rearwardly of the transom board.

3. The exhaust outlet equipment according to claim 1, wherein the discharge port communicates with a pump room of the water jet pump that opens toward the ambient side to allow the exhaust gas to be discharged outside the watercraft through the pump room.

4. The exhaust outlet equipment according to claim 1, wherein a resonator is provided separate from the exhaust pressure reducing chamber, and the resonator and the exhaust pressure reducing chamber are configured to communicate with each other through a tube.

5. The exhaust outlet equipment according to claim 4, wherein the resonator is provided above the exhaust pressure reducing chamber and a communicating port for dropping water within the resonator is provided on a lower portion of the resonator to allow the resonator and the exhaust pressure reducing chamber to communicate with each other.

6. The exhaust outlet equipment according to claim 1, wherein a first bellows valve is attached to the introduction port so as to open toward an inside of the exhaust pressure reducing chamber by an exhaust pressure of the exhaust gas.

7. The exhaust outlet equipment according to claim 1, wherein a second bellows valve is attached to the discharge port so as to open toward the ambient side by an exhaust pressure of the exhaust gas.

8. The exhaust outlet equipment according to claim 7, wherein the second bellows valve is provided with a slit.

9. A pipe mounting structure comprising:

a pipe attached to a wall having a first smooth wall face and a second rough wall face so as to penetrate through the wall such that a first end of the pipe is located on the first wall face side and a second end of the pipe is located on the second wall face side, the pipe including a flange portion in contact with the second wall face on the second end side, and a reduced diameter portion penetrating the wall to extend from the flange portion to the first end of the pipe, the reduced-diameter portion having a female screw on an inner peripheral face thereof;

a fixing member attached to the first end of the pipe, the fixing member including a screw-engagement portion provided with a male screw to be attached to the female screw on an outer peripheral face thereof, and a flange portion having a large-diameter portion extending radially from the screw-engagement portion so as to have an outer diameter larger than an outer diameter of the first end of the pipe; and a seal member provided between the first wall face and the flange portion of the fixing member, wherein the pipe is attached to the wall in such a manner that the screw-engagement portion of the fixing member is screwed to the female screw of the first end of the pipe with the wall and the seal member seized between the flange portion of the pipe and the fixing member.

10. The pipe mounting structure according to claim 9, wherein the flange portion is formed of a step portion obtained by reducing a diameter of the first end portion of the pipe.

11. The pipe mounting structure according to claim 9, further comprising an O-ring for sealing between the first end of the pipe and the fixing member in contact with the first end.

12. The pipe mounting structure according to claim 9, wherein the first wall face is an outer face of a body of the small watercraft and the pipe is an exhaust pipe of the watercraft.

13. The pipe mounting structure according to claim 9, further comprising an intermediate member provided between the seal member and the fixing member so as to have faces in contact with the seal member and the large-diameter portion of the flange portion of the fixing member.

14. An exhaust outlet equipment provided at a downstream end portion of an exhaust passage of a propulsion engine in a flow of an exhaust gas, the engine being mounted in a small watercraft propelled by a waterjet pump, the equipment comprising:

an exhaust pressure reducing chamber provided laterally of a pump room that contains the water jet pump, the chamber having a volume for reducing a pressure of the exhaust gas to a predetermined pressure;

wherein the exhaust pressure reducing chamber has an introduction port through which the exhaust gas from an exhaust pipe located on an upstream side in the flow of the exhaust gas flows into the exhaust pressure reducing chamber, and a discharge port through which the exhaust gas inside the exhaust pressure reducing chamber is discharged to an ambient side; and wherein a first bellows valve is attached to the introduction port so as to open toward an inside of the exhaust pressure reducing chamber by an exhaust pressure of the exhaust gas.

15. The exhaust outlet equipment according to claim 14, wherein a second bellows valve is attached to the discharge port so as to open toward the ambient side by an exhaust pressure of the exhaust gas.

16. An exhaust outlet equipment provided at a downstream end portion of an exhaust passage of a propulsion engine in a flow of an exhaust gas, the engine being mounted in a small watercraft propelled by a waterjet pump, the equipment comprising:

an exhaust pressure reducing chamber provided laterally of a pump room that contains the water jet pump, the chamber having a volume for reducing a pressure of the exhaust gas to a predetermined pressure;

wherein the exhaust pressure reducing chamber has an introduction port through which the exhaust gas from an exhaust pipe located on an upstream side in the flow of the exhaust gas flows into the exhaust pressure reducing chamber, and a discharge port through which the exhaust gas inside the exhaust pressure reducing chamber is discharged to an ambient side;

wherein a second bellows valve is attached to the discharge port so as to open toward the ambient side by an exhaust pressure of the exhaust gas; and wherein the second bellows valve is provided with a slit.

17. An exhaust outlet equipment provided at a downstream end portion of an exhaust passage of a propulsion engine in a flow of an exhaust gas, the engine being mounted in a small watercraft propelled by a water jet pump, the equipment comprising:

an exhaust pressure reducing chamber provided laterally of a pump room that contains the waterjet pump, the chamber having a volume for reducing a pressure of the exhaust gas to a predetermined pressure;

wherein the exhaust pressure reducing chamber has an introduction port through which the exhaust gas from an exhaust pipe located on an upstream side in the flow of the exhaust gas flows into the exhaust pressure reducing chamber, and a discharge port through which the exhaust gas inside the exhaust pressure reducing chamber is discharged to an ambient side;

wherein the exhaust pressure reducing chamber is provided at a rear end of the exhaust passage; and wherein a part of an outer wall of the exhaust pressure reducing chamber is configured to have a protruding portion in a ring shape forming the discharge port, such that the protruding portion extends within a through hole formed on the hull.

* * * * *